US006038894A

United States Patent [19]

Hu

[11] Patent Number: 6,038,894

[45] Date of Patent: Mar. 21, 2000

[54] DOOR LOCK

[75] Inventor: Francisco Hu, Nan Tou Hsien, Taiwan

[73] Assignee: Shyang Feng Electric & Machinery Co., Inc., Taiwan

[21] Appl. No.: 09/010,222

[22] Filed: Jan. 21, 1998

[51] Int. Cl.[7] ..... E05B 13/10

[52] U.S. Cl. ..... 70/224; 70/467; 70/478; 292/336.5; 292/356; 292/DIG. 64

[58] Field of Search ..... 292/336.5, 358, 292/359, 169.15, 169.21, 169.22, 169.23, DIG. 53, DIG. 64; 70/224, 476, 467, 477, 478, 479, 483, 484, 221–223, 215–217, DIG. 32

[56] References Cited

U.S. PATENT DOCUMENTS

| | | | |
|---|---|---|---|
| 2,618,955 | 11/1952 | Cerf, Jr. | 70/476 |
| 2,738,666 | 3/1956 | Tornoe | 70/216 |
| 2,739,472 | 3/1956 | North et al. | 292/169.23 |
| 2,998,273 | 8/1961 | Unetic | 70/216 |
| 2,998,274 | 8/1961 | Russell | 70/216 |
| 3,428,352 | 2/1969 | Check | 292/359 |
| 4,201,069 | 5/1980 | Katayama et al. | 70/224 |
| 4,631,944 | 12/1986 | Gater et al. | 70/223 |
| 5,004,278 | 4/1991 | Kang et al. | 292/359 |
| 5,481,890 | 1/1996 | Millman | 70/224 |
| 5,732,578 | 3/1998 | Kang | 70/224 |
| 5,809,815 | 9/1998 | Lee | 70/224 |
| 5,845,522 | 12/1998 | Shen | 292/DIG. 44 |

*Primary Examiner*—Darnell M. Boucher
*Attorney, Agent, or Firm*—Alan Kamrath; Oppenheimer, Wolff & Donnelly, LLP

[57] ABSTRACT

A door lock has a first handle, a second handle, and a lock device disposed between the first handle and the second handle. The lock device has a disk disposed on the second handle, an annular cover disposed on the first handle, a sleeve disposed on the disk, an annular dish, an annular spring, a cage ring, and an annular cage seat disposed in the annular cover in order, a case disposed between the sleeve and the annular cage seat, a draft block inserted in the case, a core inserted in the first handle, a tube inserted in the second handle, a button inserted in a rear end of the tube, an extended rod extending from the button and inserted in the tube, a pipe inserted in the first handle, a collar inserted in the disk, a positioning plate inserted in the sleeve, a hollow cylinder device inserted in the pipe, a compression spring inserterd in the hollow cylinder device, and a block seat disposed in the draft block.

2 Claims, 3 Drawing Sheets

DOOR LOCK

BACKGROUND OF THE INVENTION

The present invention relates to a door lock. More particularly, the present invention relates to a door lock which will not be damaged while a key is rotated too strongly.

The conventional door locks have been used for a long period of time. However, the door lock may be damaged while the user rotates a key too strongly.

SUMMARY OF THE INVENTION

An object of the present invention is to provide a door lock which will not be damaged while a key is rotated too strongly.

Accordingly, a door lock comprises a first handle, a second handle, and a lock device disposed between the first handle and the second handle. The lock device comprises a disk disposed on the second handle, an annular cover disposed on the first handle, a sleeve disposed on the disk, an annular dish, an annular spring, a cage ring, and an annular cage seat disposed in the annular cover in order, a case disposed between the sleeve and the annular cage seat, a draft block inserted in the case, a core inserted in the first handle, a tube inserted in the second handle, a button inserted in a rear end of the tube, an extended rod extending from the button and inserted in the tube, a pipe inserted in the first handle, a collar inserted in the disk, a positioning plate inserted in the sleeve, a hollow cylinder device insert-erd in the pipe, a compression spring inserterd in the hollow cylinder device, and a block seat disposed in the draft block. The draft block has a U-shpaed plate and two push plates defining a hollow interior. The block seat has two protuberances receiving two coiled springs. The tube has a channel, a cross-shaped groove receiving a first cage plate, and a distal flange inserted in the draft block. An elastic plate has a circular hole, an upper flange, and a lower flange. The hollow cylinder device has a drive block, an oblong hole, a center hole, a first end, a second end, a driven plate disposed on the first end, and two inner protrusions disposed in the second end. A tip end of the core is inserted in the center hole. The pipe has a notch, a cross-shaped hole receiving a second cage plate, and a cage hole. The upper flange passes through the oblong hole and the notch.

DETAILED DESCRIPTION OF THE INVENTION

Figure 1:
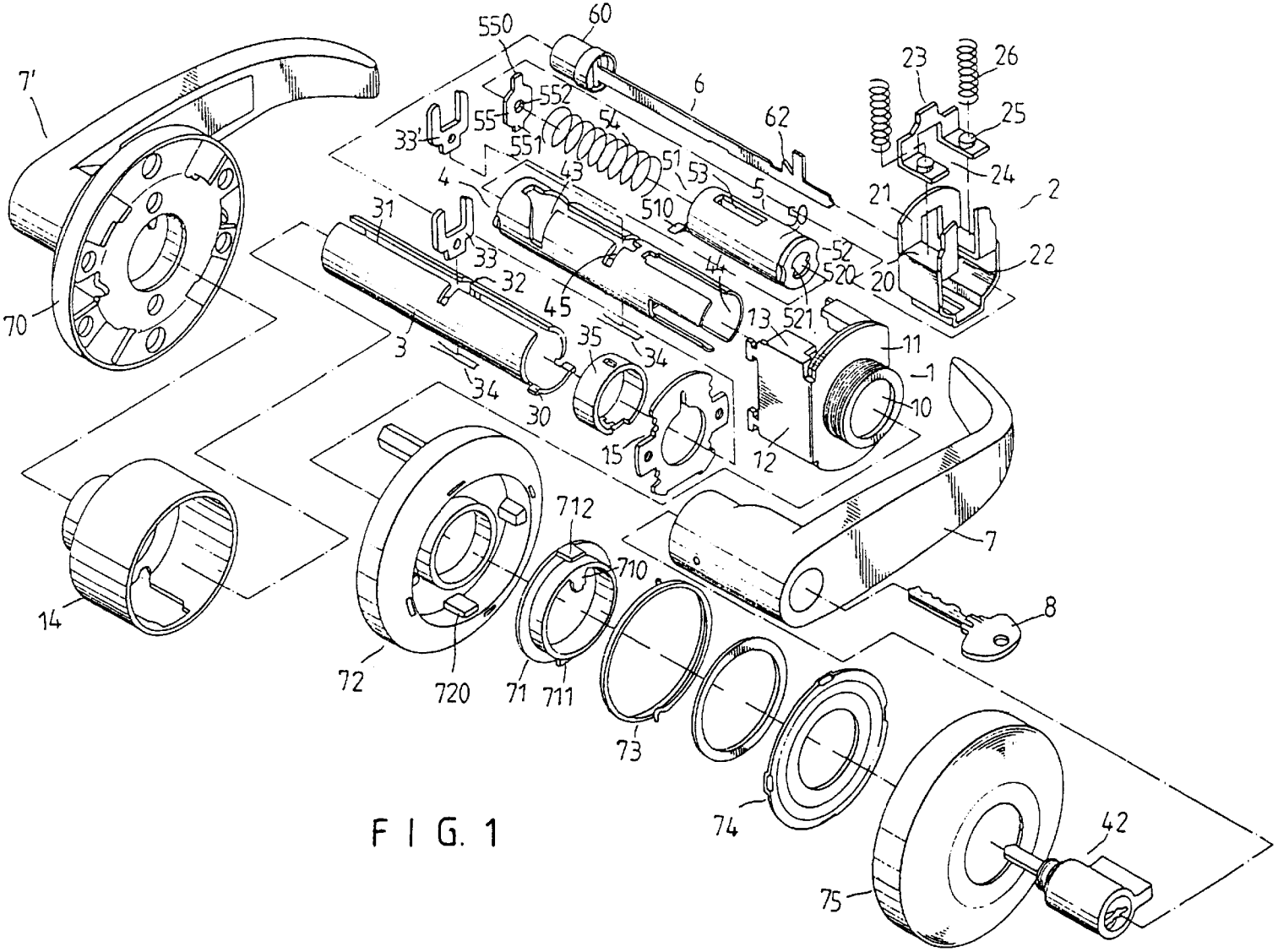
FIG. 1 is a perspective exploded view of a door lock of a preferred embodiment in accordance with the present invention.
Figure 2:
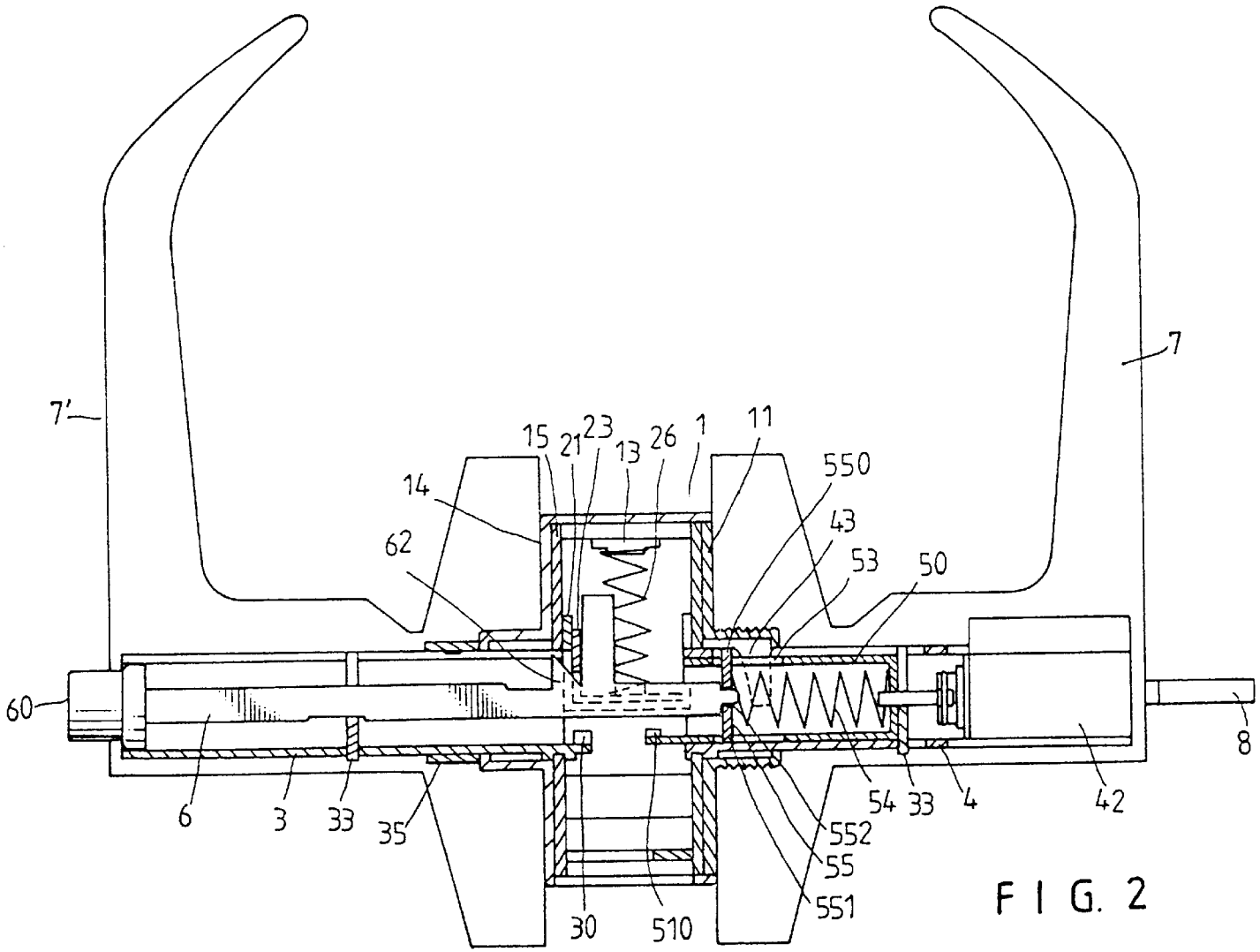
FIG 2 is a sectional view of a door lock while the door lock is unlocked.

Referring to FIGS. 1 and 2, a door lock comprises a first handle 7, a second handle 7', and a lock device disposed between the first handle 7 and the second handle 7'. The lock device comprises a disk 70 disposed on the second handle 7', an annular cover 75 disposed on the first handle 7, a sleeve 14 disposed on the disk 70, an annular dish 74, an annular spring 73, a cage ring 71, and an annular cage seat 72 disposed in the annular cover 75 in order, a case 1 disposed between the sleeve 14 and the annular cage seat 72, a draft block 2 inserted in the case 1, a core 42 inserted in the first handle 7, a tube 3 inserted in the second handle 7', a button 60 inserted in a rear end of the tube 3, an extended rod 6 extending from the button 60 and inserted in the tube 3, a pipe 4 inserted in the first handle 7, a collar 35 inserted in the disk 70, a positioning plate 15 inserted in the sleeve 14, a hollow cylinder device 5 inserted in the pipe 4, a compression spring 54 inserted in the hollow cylinder device 5, and a block seat 23 disposed in the draft block 2.

The draft block 2 has a U-shaped plate 21 and two push plates 20 defining a hollow interior 22. The block seat 23 has two protuberances 25 receiving two coiled springs 26.

The tube 3 has a channel 31, a cross-shaped groove 32 receiving a first cage plate 33, and a distal flange 30 inserted in the draft block 2.

An elastic plate 55 has a circular hole 552, an upper flange 550, and a lower flange 551.

The hollow cylinder device 5 has a drive block 50, an oblong hole 53, a center hole 520, a first end 51, a second end 52, a driven plate 510 disposed on the first end 51, and two inner protrusions 521 disposed in the second end 52. A tip end of the core 42 is inserted in the center hole 520.

The pipe 4 has a notch 43, a cross-shaped hole 45 receiving a second cage plate 33', and a cage hole 44. The upper flange 550 passes through the oblong hole 53 and the notch 43.

The annular cage seat 72 has two inner blocks 720. The cage ring 71 has a column 712, an inner post 710 and an outer post 711. The extended rod 6 has a block end 62.

Figure 3:
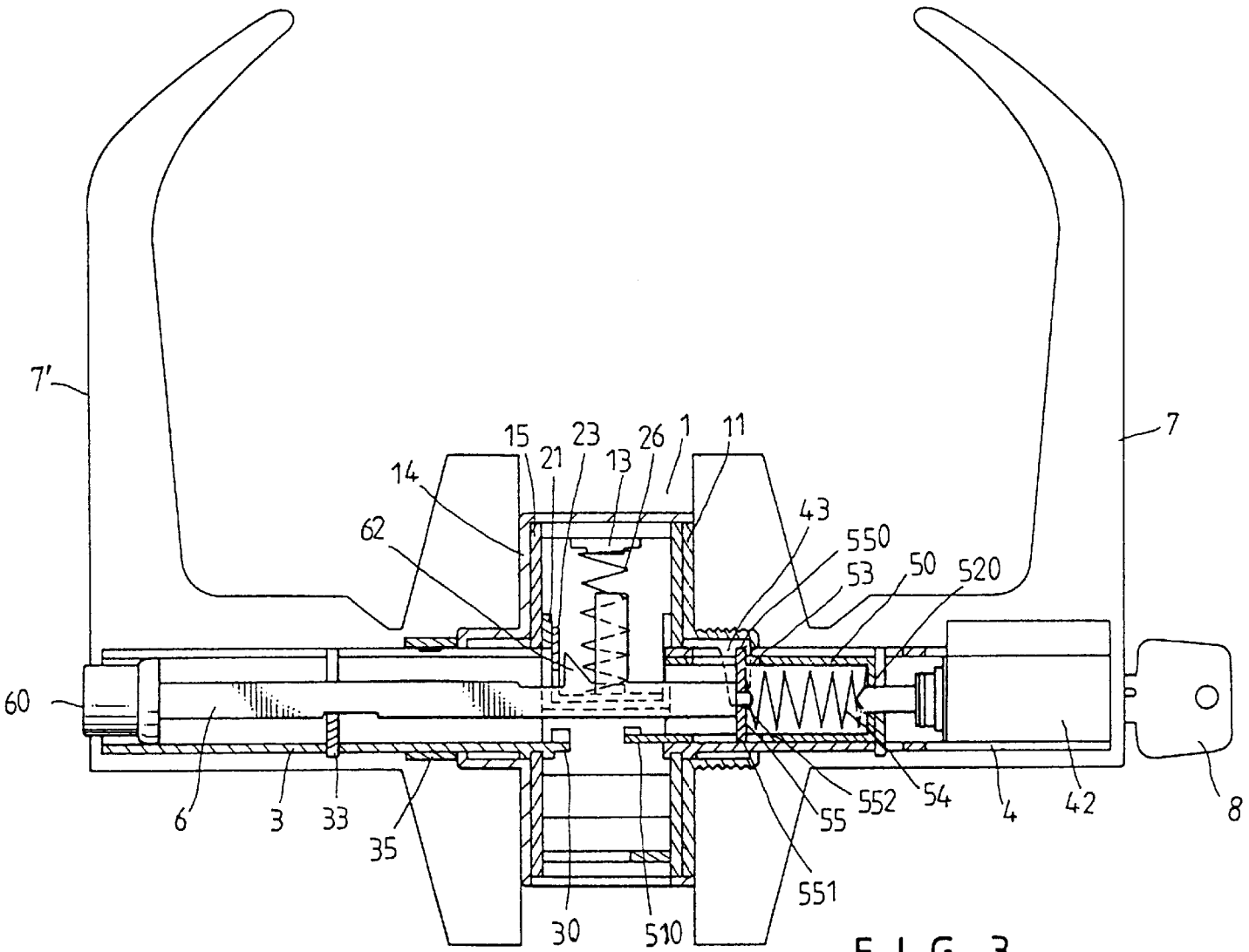
FIG. 3 is a sectional view of a door lock while the door lock is locked.

Referring to FIG. 3, a key 8 is inserted in the core 42 to lock the door lock. The notch 43 has enough room to receive the upper flange 550. Therefore, the door lock will not be damaged while the key 8 is rotated too strongly.

When the button 60 is pressed, the block end 62 will move forward to be engaged with the block seat 23. The elastic plate 55 will move forward also.

When the second handle 7' is rotated, the tube 3 will be rotated also. The push plates 20 and the block seat 23 are pushed. The block end 62 is lifted. The elastic plate 55 is forced to move rearward by the compression spring 54.

The invention is not limited to the above embodiment but various modification thereof may be made. Further, various changes in form and detail may be made without departing from the scope of the invention.

I claim:

1. A door lock comprises:

a first handle, a second handle, and a lock device disposed between the first handle and the second handle, the lock device comprising a disk disposed on the second handle, an annular cover disposed on the first handle, a sleeve disposed on the disk, an annular disk, an annular spring, a cage ring, and an annular cage seat disposed in the anular cover in order, a case disposed between the sleeve and the annular cage seat, a draft block inserted in the case, a core inserted in the first handle, a tube inserted in the second handle, a button inserted in a rear end of the tube, an extended rod extending from the button and inserted in the tube, a pipe inserted in the first handle, a collar inserted in the disk, a positioning plate inserted in the sleeve, a hollow cylinder device inserted in the pipe, a compression spring inserted in the hollow cylinder device, and a block seat disposed in the draft block, the draft block having a U-shaped plate and two push plates defining a hollow interior, the block seat having two protuberances receiving two coiled springs, the tube having a channel, a cross-shaped groove receiving a first cage plate, and a distal lange inserted in the draft block, an elastic plate having a circular hole, an upper flange, and a lower flange, the hollow cylinder device having a drive block, an oblong hole, a center hole, a first end, a second end, a driven plate disposed on the first end, and two inner protrusions disposed in the second end, a tip end of the core inserted in the center hole, the pipe having a notch, a cross-shaped hole receiving a second cage plate, and a cage hole, the annular cage seat having two inner blocks, the cage ring having a column, an inner post and an outer post, with the cage ring being rotatable with the pipe by engagement of the inner post with the pipe, and the upper flange passing through the oblong hole and the notch, with the outer post of the cage ring being blocked by one of the two inner blocks of the annular cage seat so that the door lock will not be damaged by being rotated too strongly.

2. A door lock as claimed in claim 1, wherein the extended rod has a block end.

* * * * *